US009104170B2

(12) United States Patent
Shikata et al.

(10) Patent No.: US 9,104,170 B2
(45) Date of Patent: Aug. 11, 2015

(54) OPENING AND CLOSING MECHANISM AND IMAGE FORMING APPARATUS

(75) Inventors: Masahito Shikata, Kanagawa (JP); Masato Minagawa, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 98 days.

(21) Appl. No.: 13/593,071

(22) Filed: Aug. 23, 2012

(65) Prior Publication Data

US 2013/0251396 A1 Sep. 26, 2013

(30) Foreign Application Priority Data

Mar. 22, 2012 (JP) ..... 2012-065707

(51) Int. Cl.
*G03G 15/00* (2006.01)
*G03G 21/16* (2006.01)

(52) U.S. Cl.
CPC ..... *G03G 21/1633* (2013.01)

(58) Field of Classification Search
CPC ..... G03G 2215/00358; G03G 15/65; G03G 15/6502; G03G 2215/0054; G03G 15/00544
USPC ..... 399/111, 107, 114
See application file for complete search history.

(56) References Cited

U.S. PATENT DOCUMENTS

| | | | | |
|---|---|---|---|---|
| 6,145,832 | A | 11/2000 | Saito et al. | |
| 7,907,868 | B2 * | 3/2011 | Igarashi et al. | 399/110 |
| 2004/0190934 | A1 * | 9/2004 | Okabe | 399/111 |
| 2007/0048006 | A1 * | 3/2007 | Igarashi et al. | 399/110 |
| 2009/0016768 | A1 * | 1/2009 | Seorl et al. | 399/107 |
| 2010/0329737 | A1 * | 12/2010 | Koga et al. | 399/124 |

FOREIGN PATENT DOCUMENTS

| | | | |
|---|---|---|---|
| JP | 11-084981 | A | 3/1999 |
| JP | 3280735 | B2 | 5/2002 |

* cited by examiner

*Primary Examiner* — Benjamin Schmitt
*Assistant Examiner* — Matthew Miller
(74) *Attorney, Agent, or Firm* — Sughrue Mion, PLLC

(57) ABSTRACT

An opening and closing mechanism includes: a first opening and closing unit rotated to be opened from or closed onto an apparatus body; a drawer unit drawable from the body toward the first opening and closing unit; a second opening and closing unit drawable from the body integrally with the drawer unit, rotatable relative to the drawer unit, rotated integrally with the first opening and closing unit to be opened from or closed onto the body integrally with the first opening and closing unit, and singly rotated independently of the first opening and closing unit to be singly opened from or closed onto the body; and regulation mechanisms provided to the second opening and closing unit independently of the body and the first opening and closing unit to regulate the angle of opening, relative to the body, of the second opening and closing unit singly opened from the body.

21 Claims, 12 Drawing Sheets

OPENING AND CLOSING MECHANISM AND IMAGE FORMING APPARATUS

CROSS-REFERENCE TO RELATED APPLICATIONS

This application is based on and claims priority under 35 USC 119 from Japanese Patent Application No. 2012-065707 filed Mar. 22, 2012.

BACKGROUND

Technical Field

The present invention relates to an opening and closing mechanism and an image forming apparatus.

SUMMARY

According to an aspect of the invention, there is provided an opening and closing mechanism including a first opening and closing unit, a drawer unit, a second opening and closing unit, and regulation mechanisms. The first opening and closing unit is supported to be rotatable relative to an apparatus body, and is opened from or closed onto the apparatus body in accordance with the rotation thereof. The drawer unit is provided to the apparatus body to be drawable from the apparatus body toward a side of the apparatus body provided with the first opening and closing unit. The second opening and closing unit is supported to be drawable from the apparatus body integrally with the drawer unit and be rotatable relative to the drawer unit. The second opening and closing unit is rotated integrally with the first opening and closing unit to be opened from or closed onto the apparatus body integrally with the first opening and closing unit, and is singly rotated independently of the first opening and closing unit to be singly opened from or closed onto the apparatus body. The regulation mechanisms are provided to the second opening and closing unit independently of the apparatus body and the first opening and closing unit, and regulate the angle of opening, relative to the apparatus body, of the second opening and closing unit singly opened from the apparatus body.

BRIEF DESCRIPTION OF THE DRAWINGS

An exemplary embodiment of the present invention will be described in detail based on the following figures, wherein.

DETAILED DESCRIPTION

An example of an exemplary embodiment of the present invention will be described below on the basis of the drawings.

Figure 1:
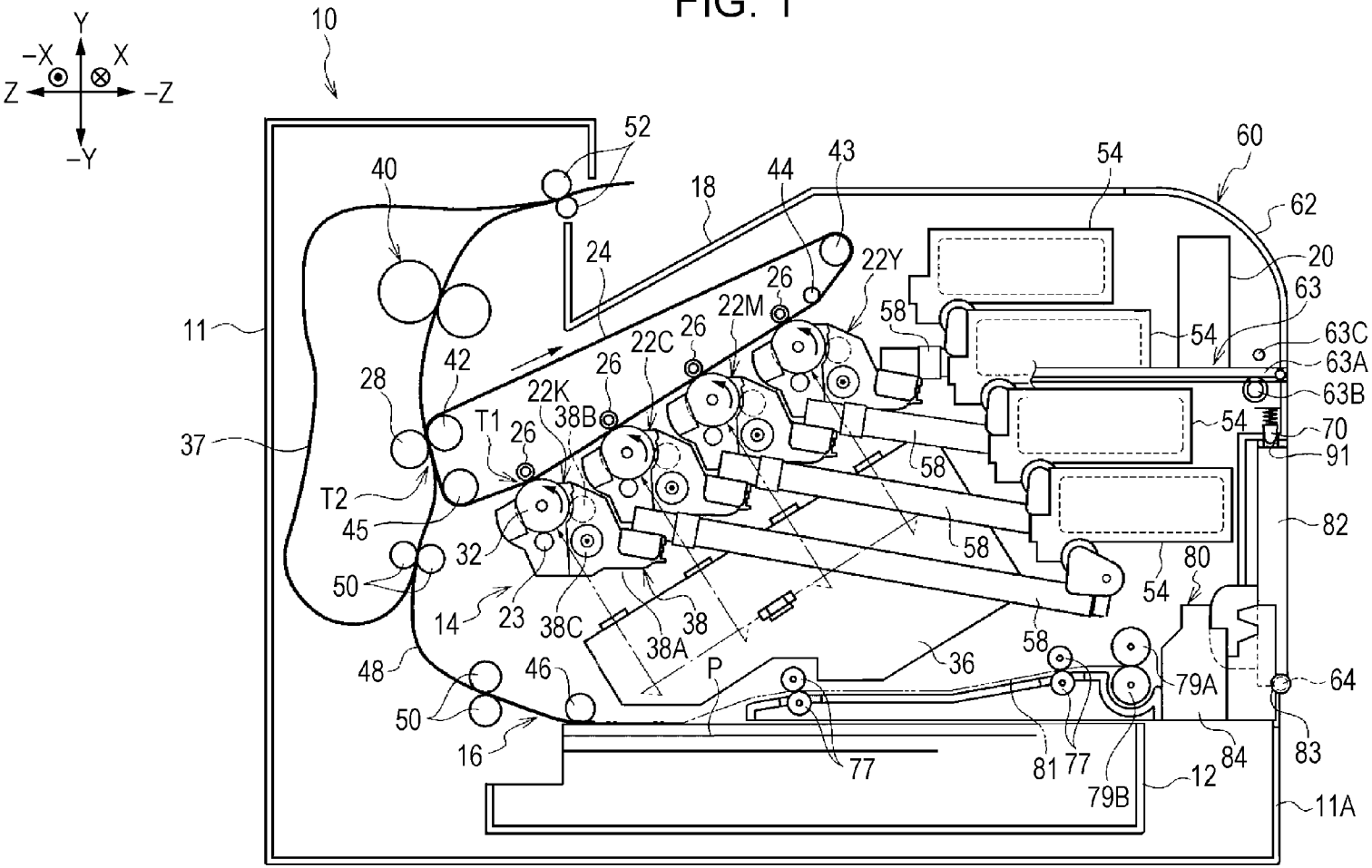
FIG. 1 is a schematic diagram illustrating a configuration of an image forming apparatus according to the present exemplary embodiment.

Configuration of Image Forming Apparatus 10 according to Exemplary Embodiment: A confiuguration of an image forming apparatus 10 according to the present examplery embodiment will be first described. FIG. 1 is a schematic diagram illustrating the configuration of the image forming apparatus 10 according to the exemplary embodiment. An X direction, a −X direction, a Y direction (upward), a −Y direction (downward), a Z direction, and a −Z direction described below represent the directions of arrows illustrated in the drawings. Further, a cross mark drawn inside a white circle represents an arrow directed from the near side toward the far side of the drawings, and a black dot drawn inside a white circle represents an arrow directed from the far side toward the near side of the drawings.

As illustrated in FIG. 1, the image forming apparatus 10 includes an image forming apparatus body 11 provided with constituent components. The image forming apparatus body 11 includes therein a storage unit 12 which stores a recording medium P, such as a sheet, an image forming section 14 which forms an image on the recording medium P, a transport unit 16 which transports the recording medium P from the storage unit 12 to the image forming section 14, and a controller 20 which controls the operations of respective units of the image forming apparatus 10. Further, an upper part of the image forming apparatus body 11 includes a discharge unit 18, to which the recording medium P having the image formed by the image forming section 14 is discharged.

The image forming section 14 includes image forming units 22Y, 22M, 22C, and 22K (hereinafter referred to as 22Y to 22K) which form toner image of yellow (Y), magenta (M), cyan (C), and black (K) colors, respectively, an intermediate transfer belt 24 to which the toner images formed by the image forming units 22Y to 22K are transferred, first transfer rollers 26 which transfer the toner images formed by the image forming units 22Y to 22K to the intermediate transfer belt 24, and a second transfer roller 28 which transfers, from the intermediate transfer belt 24 to the recording medium P, the toner images transferred to the intermediate transfer belt 24 by the first transfer rollers 26. The image forming section 14 is not limited to the above-described configuration, and may have another configuration, as long as the image forming section 14 forms an image on the recording medium P.

The image forming units 22Y to 22K are aligned in the image forming apparatus body 11, as inclined relative to the horizontal directions (Z and −Z directions). Further, each of the image forming units 22Y to 22K includes a photoconductor 32 which rotates in one direction (counterclockwise direction in FIG. 1, for example). The image forming units 22Y to 22K are similarly configured. In FIG. 1, therefore, the reference symbols designating the respective components of the image forming units 22Y, 22M, and 22C are omitted.

Around the circumference of each of the photoconductors 32, a charging roller 23 and a developing device 38 are sequentially provided from the upstream side in the rotation direction of the photoconductor 32. The charging roller 23 is an example of a charging device which charges the photoconductor 32. The developing device 38 forms a toner image by developing an electrostatic latent image formed on the photoconductor 32 by an exposure process of a later-described exposure device 36 performed on the photoconductor 32 charged by the charging roller 23.

On the obliquely lower right side of the image forming units 22Y to 22K in FIG. 1, the exposure device 36 is provided which forms electrostatic latent images on the photoconductors 32 by performing the exposure process on the photoconductors 32 charged by the charging rollers 23. The exposure device 36 forms the electrostatic latent images on the basis of an image signal transmitted from the controller 20. The image signal transmitted from the controller 20 includes, for example, an image signal acquired from an external device by the controller 20.

Each of the developing devices 38 includes a housing 38A which stores a developer containing a toner, a developer supply member 38B which is supported by the housing 38A and supplies the developer to the photoconductor 32, and a transport member 38C which transports the developer to be supplied to the developer supply member 38B, while stirring the developer.

The intermediate transfer belt 24 is formed into a loop shape, and is disposed on the upper side (Y direction side) of the image forming units 22Y to 22K. On the inner circumferential side of the intermediate transfer belt 24, winding rollers 42, 43, 44, and 45 are provided which have the intermediate transfer belt 24 wound therearound. When one of the winding rollers 42, 43, 44, and 45 is driven to rotate, the intermediate transfer belt 24 circularly moves (rotates) in one direction (clockwise direction in FIG. 1, for example) while in contact with the photoconductors 32. The winding roller 42 serves as a facing roller facing the second transfer roller 28.

Each of the first transfer rollers 26 faces the corresponding photoconductor 32 across the intermediate transfer belt 24. The space between each of the first transfer rollers 26 and the corresponding photoconductor 32 corresponds to a first transfer position T1 at which the toner image formed on the photoconductor 32 is transferred to the intermediate transfer belt 24.

The second transfer roller 28 faces the winding roller 42 across the intermediate transfer belt 24. The space between the second transfer roller 28 and the winding roller 42 corresponds to a second transfer position T2 at which the toner image transferred to the intermediate transfer belt 24 is transferred to the recording medium P.

The transport unit 16 includes a feed roller 46 which feeds the recording medium P stored in the storage unit 12, a transport path 48 for transporting the recording medium P fed by the feed roller 46, and plural transport rollers 50 which are disposed along the transport path 48 and transport to the second transfer position T2 the recording medium P fed by the feed roller 46.

On the downstream side of the second transfer position T2 in a transport direction, a fixing device 40 is provided which fixes on the recording medium P the toner image formed on the recording medium P by the image forming section 14. On the downstream side of the fixing device 40 in the transport direction, discharge rollers 52 are provided which discharge to the discharge unit 18 the recording medium P having the toner image fixed thereon.

Further, on a side (Z direction side) of the transport path 48 opposite to the intermediate transfer belt 24, a reversing transport path 37 is provided which reverses the recording medium P having the toner image fixed on one surface thereof and transports the recording medium P back to the second transfer position T2. When an image is to be formed on each of both surfaces of the recording medium P, the recording medium P having a toner image fixed on one surface thereof is switched back by the discharge rollers 52 to be guided to the reversing transport path 37 and transported back to the second transfer position T2.

Further, a −Z direction-side part of the image forming apparatus body 11 includes plural developer storing containers 54 (toner cartridges) which store developers of the respective colors and plural transport tubes 58 which transport to the developing devices 38 the developers discharged from the developer storing containers 54. Specifically, the developer storing containers 54 are provided to be attachable to the image forming apparatus body 11 in the Z direction and detachable from the image forming apparatus body 11 in the −Z direction, and are aligned along the vertical directions (Y and −Y directions).

Figure 4:
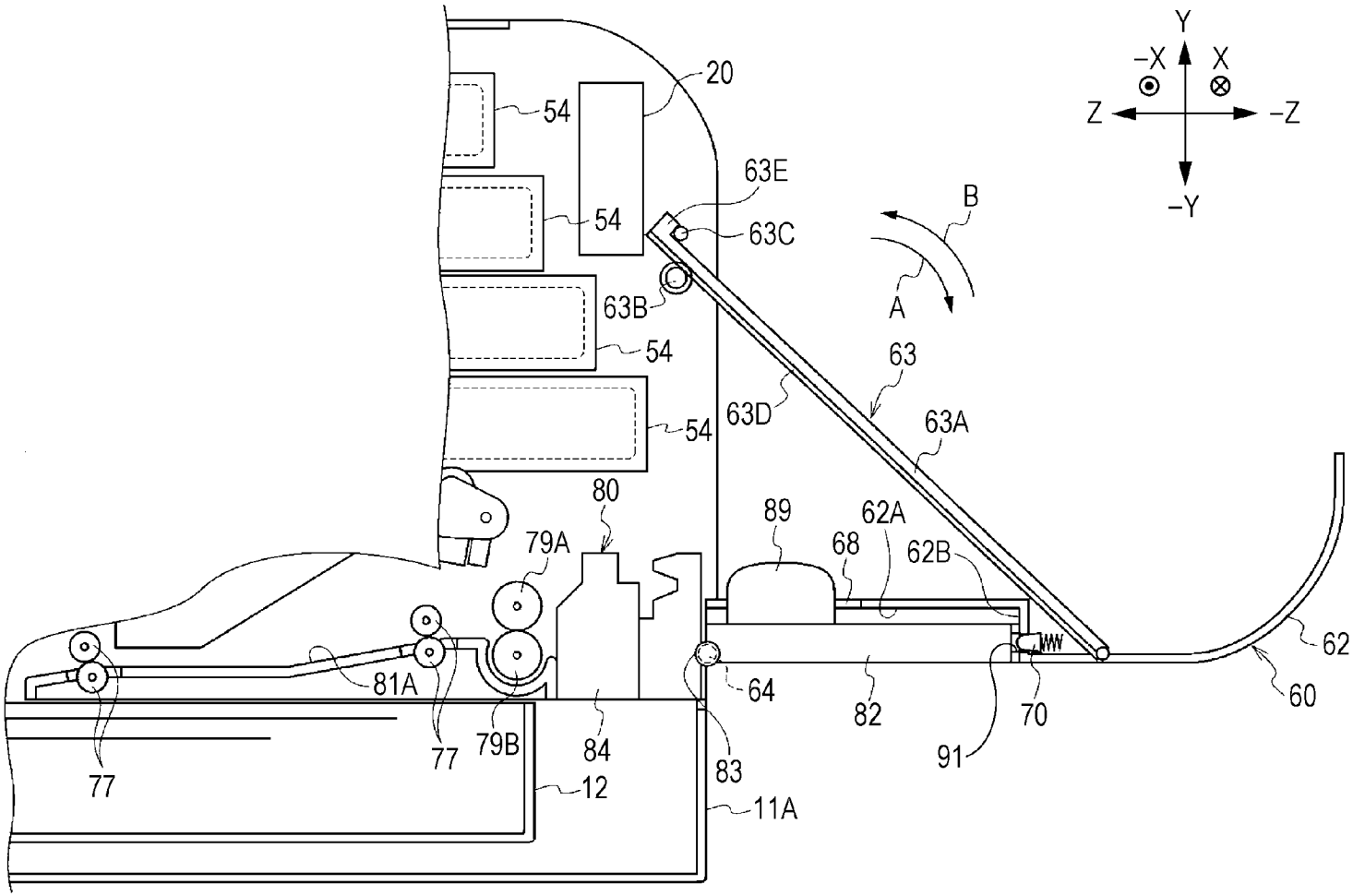
FIG. 4 is a schematic diagram illustrating a state in which a front cover and a manual feed tray cover according to the exemplary embodiment are opened from the image forming apparatus body.

Further, a −Z direction-side side surface 11A of the image forming apparatus body 11 is provided with an opening and closing mechanism 60 which is opened from and closed onto the image forming apparatus body 11. As illustrated in FIG. 4, in a state in which the opening and closing mechanism 60 is opened from the image forming apparatus body 11, the developer storing containers 54 are detachable from an attachment part (illustration omitted) provided in the image forming apparatus body 11 in a predetermined detaching direction (−Z direction), and are attachable to the attachment part in a predetermined attaching direction (Z direction). A specific configuration of the opening and closing mechanism 60 will be described later.

Subsequently, description will be made of an image forming operation of forming an image on the recording medium P, which is performed in the image forming apparatus 10 according to the exemplary embodiment.

In the image forming apparatus 10 according to the exemplary embodiment, the recording medium P fed from the storage unit 12 by the feed roller 46 is transported to the second transfer position T2 by the plural transport rollers 50.

Meanwhile, in the image forming units 22Y to 22K, the photoconductors 32 charged by the charging rollers 23 are exposed to light by the exposure device 36, and thereby electrostatic latent images are formed on the photoconductors 32. The electrostatic latent images are developed by the developing devices 38, and thereby toner images are formed on the photoconductors 32. The toner images of the respective colors formed by the image forming units 22Y to 22K are superimposed on the intermediate transfer belt 24 at the first transfer positions T1, and thereby a color image is formed. Then, the color image formed on the intermediate transfer belt 24 is transferred to the recording medium P at the second transfer position T2.

The recording medium P having the toner image transferred thereto is transported to the fixing device 40, and the transferred toner image is fixed on the recording medium P by the fixing device 40. When an image is to be formed only on one surface of the recording medium P, the recording medium P having a toner image fixed thereon is discharged to the discharge unit 18 by the discharge rollers 52.

When an image is to be formed on each of both surfaces of the recording medium P, the recording medium P having an image formed on one surface thereof is switched back by the discharge rollers 52 to be reversed and transported to the reversing transport path 37. The recording medium P is further transported back to the second transfer position T2 from the reversing transport path 37, and an image is formed, in a similar manner as in the above-described process, on the opposite surface of the recording medium P not recorded with an image. Thereby, the image is formed on each of both surfaces of the recording medium P. The recording medium P is then discharged to the discharge unit 18 by the discharge rollers 52. In the above-described manner, a series of image forming processes is performed.

Specific Configuration of Opening and Closing Mechanism 60: Subsequently, a specific configuration of the opening and closing mechanism 60 will be described.

Figure 2:
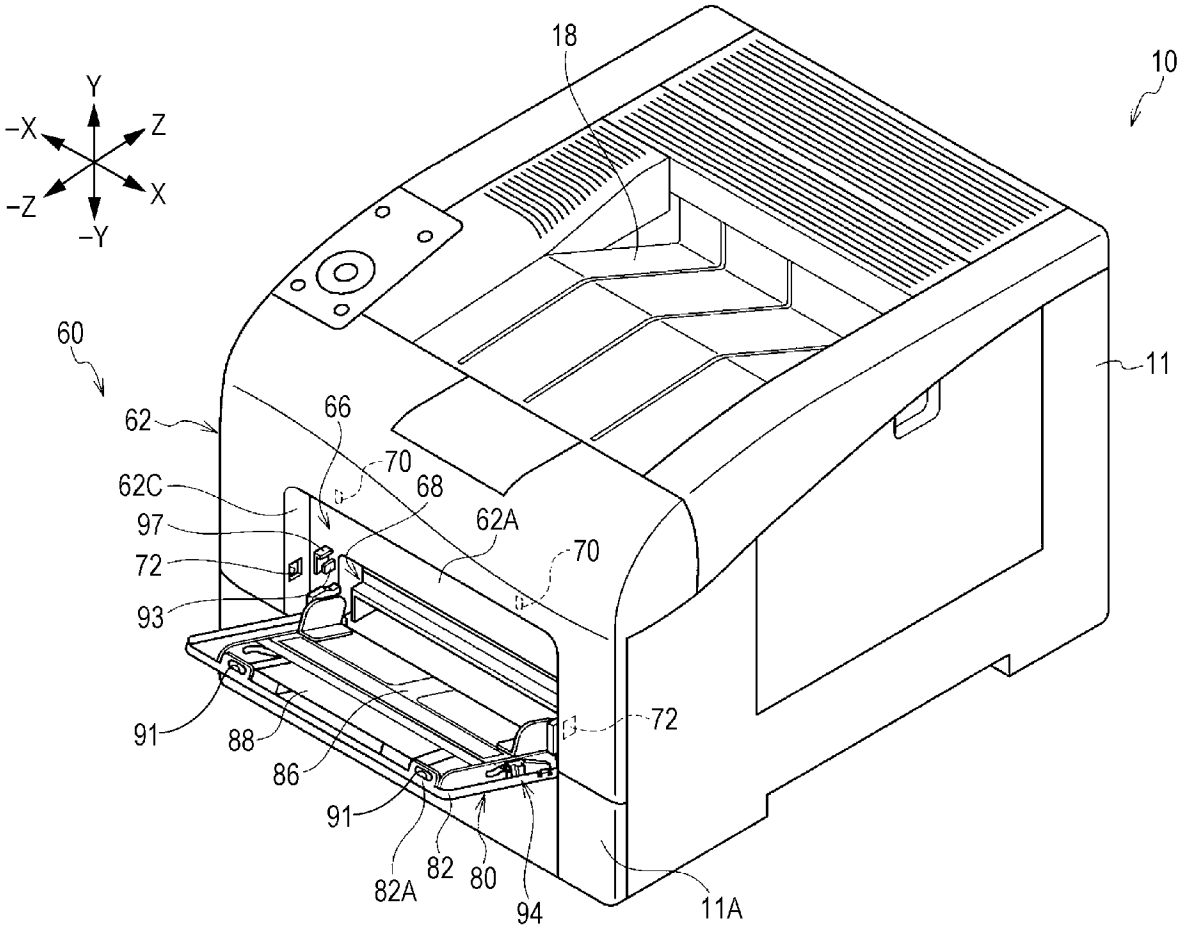
FIG. 2 is a perspective view illustrating the configuration of the image forming apparatus according to the exemplary embodiment.
Figure 3:
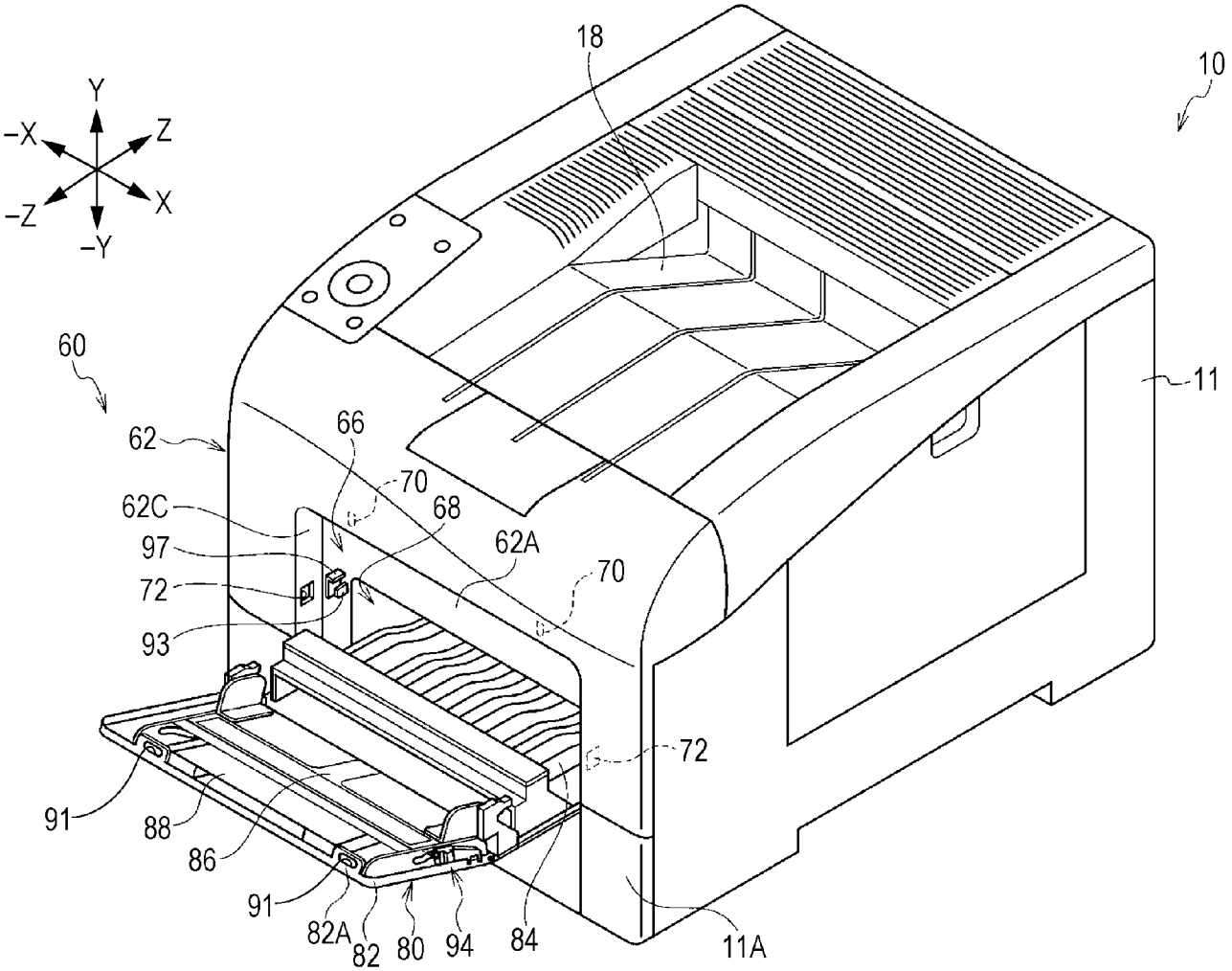
FIG. 3 is a perspective view illustrating a state in which a manual feed tray unit is drawn from an image forming apparatus body in the configuration illustrated in FIG. 2.

As illustrated in FIGS. 2 and 3, the opening and closing mechanism 60 includes a manual feed tray unit 80 including a front cover 62 and a manual feed tray cover 82. The front cover 62 is an example of a first opening and closing unit provided to be openable from and closable onto the image forming apparatus body 11. The manual feed tray cover 82 is an example of a second opening and closing unit provided to be openable from and closable onto the image forming apparatus body 11. The manual feed tray cover 82 and the front cover 62 are disposed on the same side of the 1 image forming apparatus body 11 (specifically, on the −Z direction-side side surface 11A (front side) of the image forming apparatus body 11).

The directions (particularly vertical directions) of the front cover 62 and the manual feed tray cover 82 (including a manual feed tray 86) described below refer to the directions of the front cover 62 and the manual feed tray cover 82 in the closed state thereof. Further, in FIG. 1 and FIGS. 4 to 6, the front cover 62 and the manual feed tray unit 80 are illustrated in a simplified form.

As illustrated in FIG. 4, a lower portion of the front cover 62 is supported by a support part 64 to be rotatable around an axis along the X and −X directions at a lower portion of the image forming apparatus body 11. Accordingly, when the front cover 62 rotates from the image forming apparatus body 11 toward the outside of the image forming apparatus 10 (in an A direction in FIG. 4), the front cover 62 is opened from the image forming apparatus body 11. When the front cover 62 in this state rotates toward the image forming apparatus body 11 (in a B direction in FIG. 4), the front cover 62 is closed toward the image forming apparatus body 11.

As illustrated in FIG. 4, the front cover 62 is provided with a regulation mechanism 63 which regulates the angle of opening of the front cover 62 to a predetermined angle (approximately ninety degrees, for example). The regulation mechanism 63 is configured to include, for example, a connecting member 63A connected to the front cover 62 and the image forming apparatus body 11, a pinion 63B rotatably provided to the image forming apparatus body 11, and a stopper 63C serving as a preventing part.

One end portion of the connecting member 63A is rotatably connected to the front cover 62. At an other end portion of the connecting member 63A, a rack 63D formed on the connecting member 63A and the pinion 63B are meshed with each other. In accordance with the opening or closing of the front cover 62, the other end portion of the connecting member 63A is displaced relative to the image forming apparatus body 11, with the rack 63D and the pinion 63B meshed with each other. When the front cover 62 is opened, the stopper 63C hits against a prevented portion 63E formed at the other end portion of the connecting member 63A, and prevents the connecting member 63A from being displaced in the A direction in FIG. 4. Thereby, the angle of opening of the front cover 62 is regulated to the predetermined angle (approximately ninety degrees, for example). The regulation mechanism 63 is not limited to the above-described configuration, and various configurations may be employed as the regulation mechanism 63.

Figure 5:
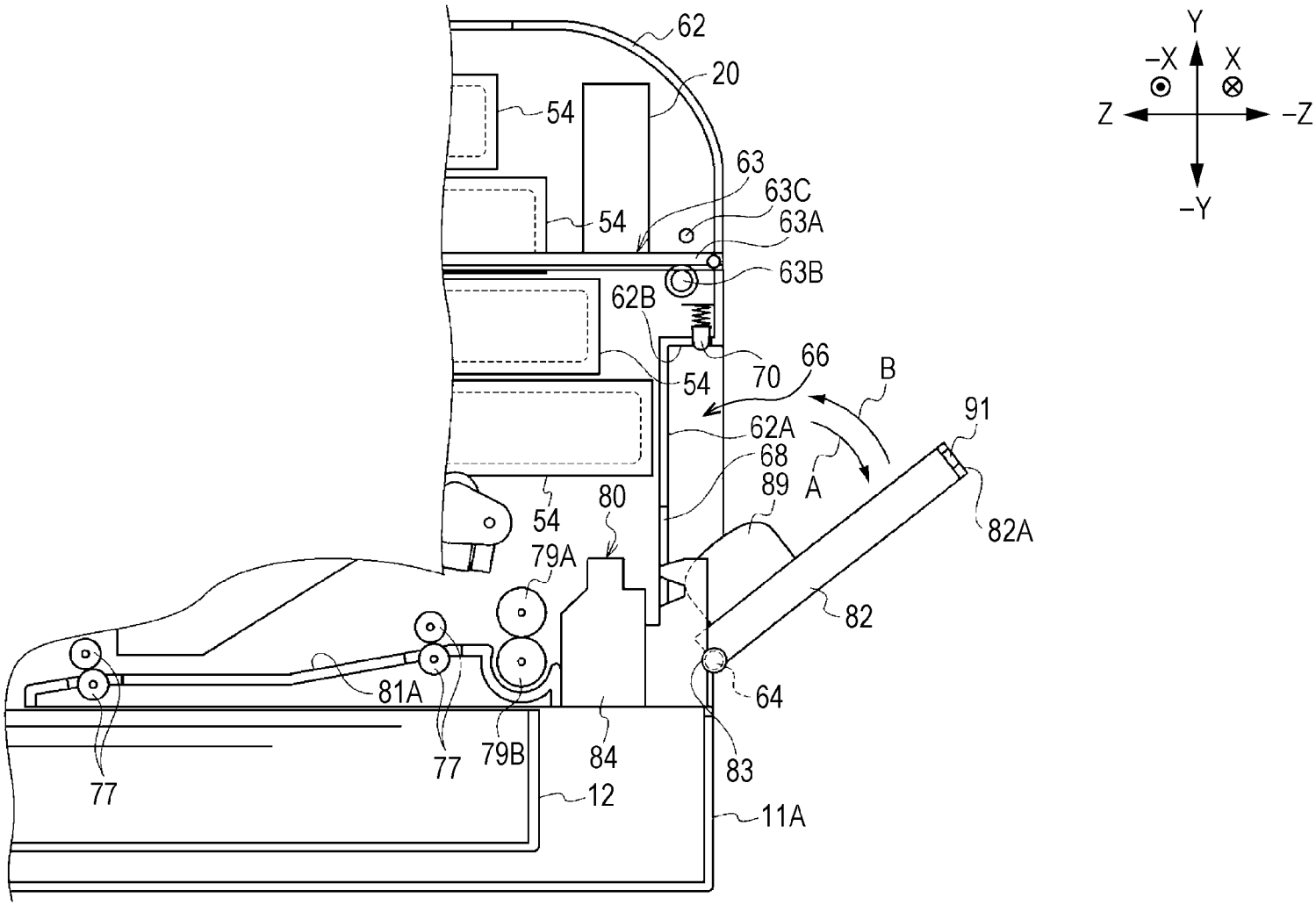
FIG. 5 is a schematic diagram illustrating a state in which the manual feed tray cover according to the exemplary embodiment is singly opened from the image forming apparatus body.

As illustrated in FIGS. 3 and 5, the front cover 62 is formed with a recess opening in the −Z direction. The recess forms a housing space 66 which houses the later-described manual feed tray 86. An inner wall 62A on the inner side (Z direction side) of the interior of the housing space 66 is formed with a through-hole 68 which passes through into the image forming apparatus body 11 (in the Z direction).

As illustrated in FIG. 5, an upper wall 62B of the interior of the housing space 66 in the front cover 62 is provided with holding projections 70 serving as holding parts for holding the manual feed tray cover 82 in the front cover 62. When fit in later-described fitting holes 91 provided in the manual feed tray cover 82, the holding projections 70 hold the manual feed tray cover 82. As illustrated in FIGS. 2 and 3, the holding projections 70 form a pair.

As illustrated in FIGS. 2 and 3, left and right side walls 62C of the interior of the housing space 66 in the front cover 62 are respectively formed with latching holes 72, in which later-described hook portions 95 (see FIG. 7) provided to the manual feed tray cover 82 are latched.

The inner wall 62A of the front cover 62 is further provided with releasing projections 93 as an example of releasing parts (pressing members). As described later, the releasing projections 93 press latch levers 96 (see FIG. 8), to thereby release the regulation of the angle of opening of the manual feed tray cover 82. Around each of the releasing projections 93, a protecting part 97 is formed which protects the releasing projection 93. The protecting part 97 is formed into an L shape, as viewed in the Z direction, and surrounds the releasing projection 93 on the upper side (Y direction side) and the −X direction side of the releasing projection 93.

Figure 7:
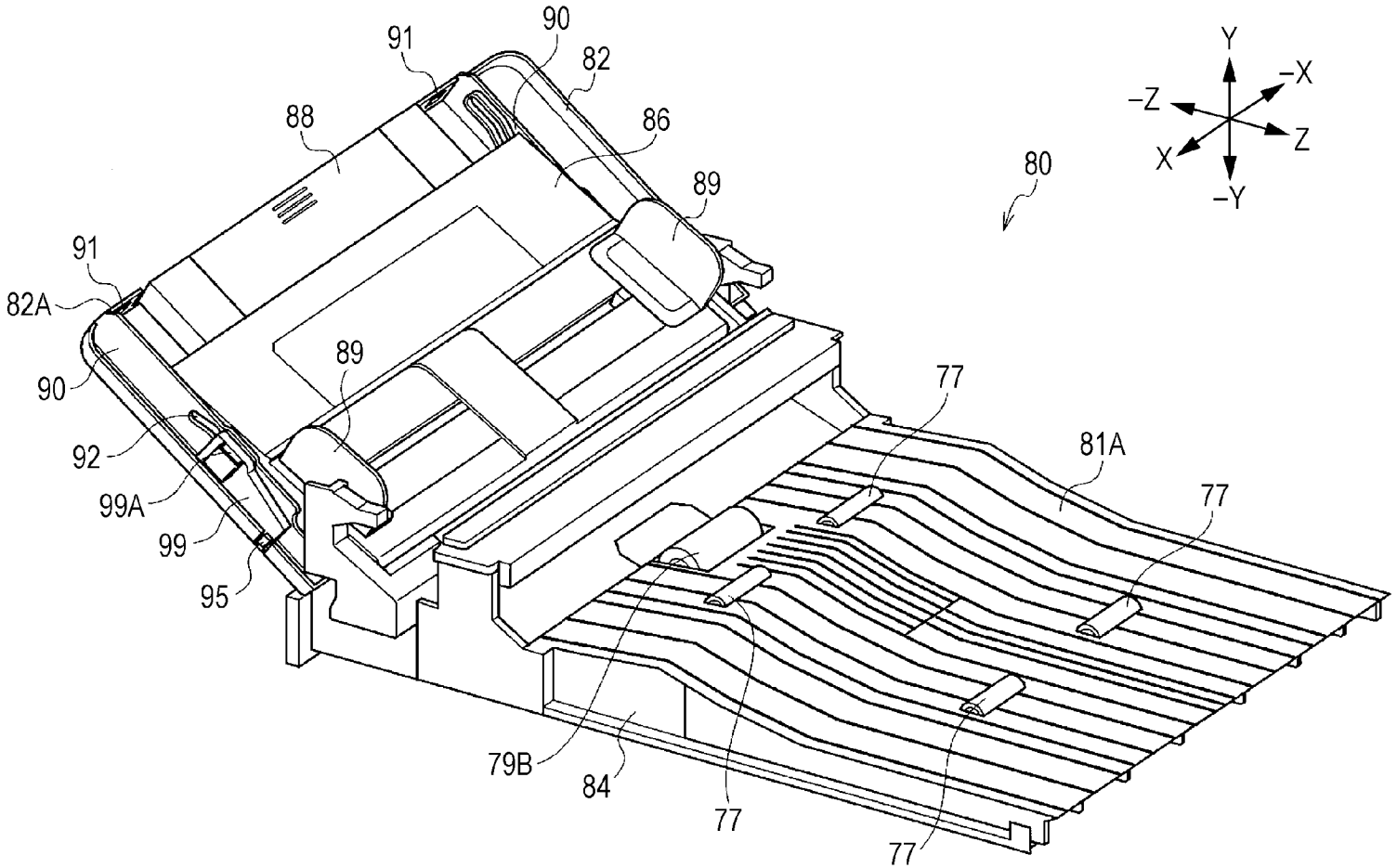
FIG. 7 is a perspective view illustrating a configuration of the manual feed tray unit according to the exemplary embodiment.

As illustrated in FIG. 7, the manual feed tray unit 80 includes a unit body 84 as an example of a drawer unit, the above-described manual feed tray cover 82 provided to the unit body 84 to be openable from and closable onto the image forming apparatus body 11, the manual feed tray 86 as an example of a storage unit, and an extension tray 88 extending toward the upper side (Y direction side) of the manual feed tray 86.

Figure 6:
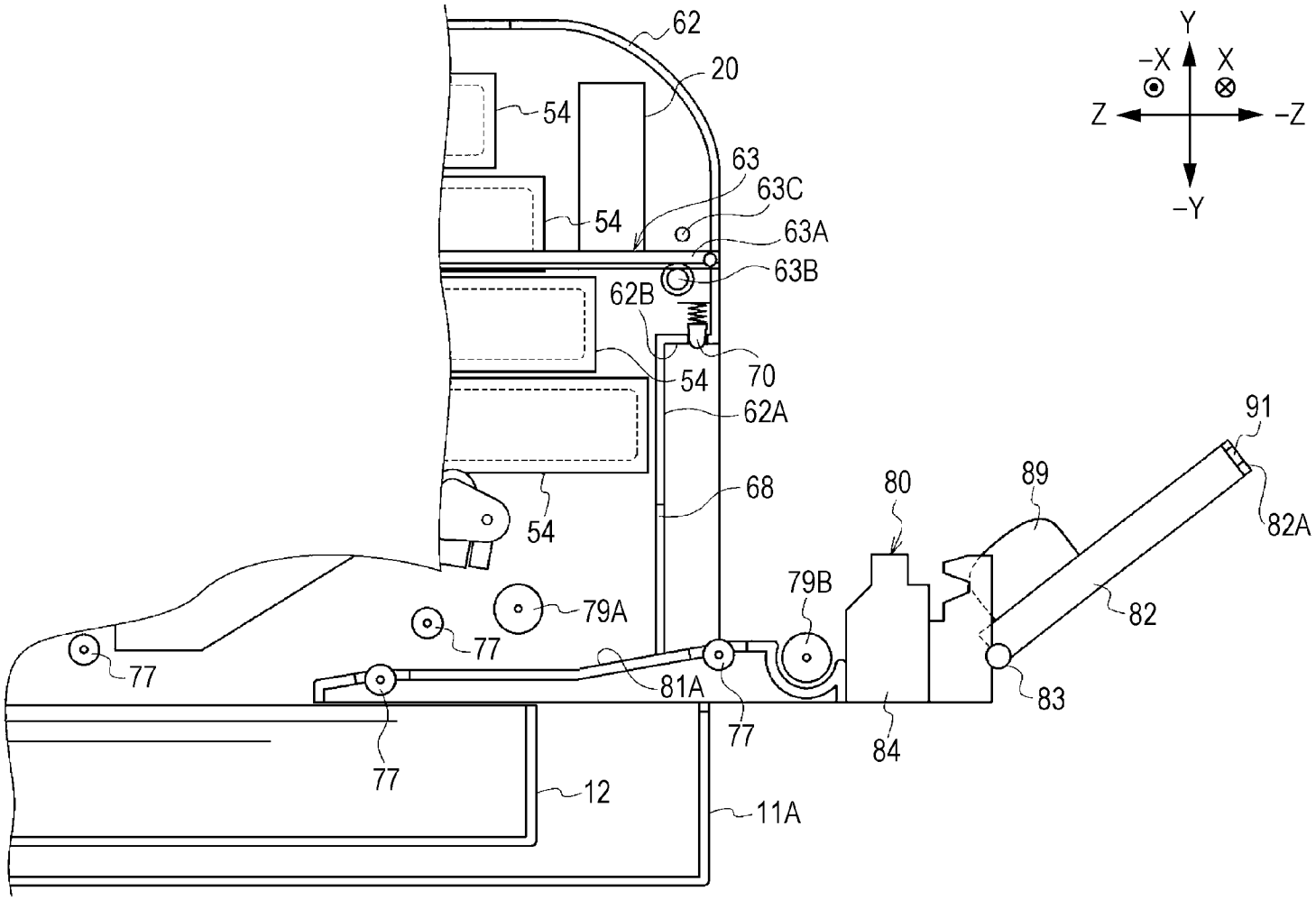
FIG. 6 is a schematic diagram illustrating a state in which the manual feed tray unit according to the exemplary embodiment is drawn from the image forming apparatus body.

As illustrated in FIGS. 3 and 6, the unit body 84 is provided to the image forming apparatus body 11 to be drawable from the image forming apparatus body 11 toward a side of the image forming apparatus body 11 provided with the front cover 62 (specifically, the −Z direction-side side surface 11A of the image forming apparatus body 11) through the through-hole 68 of the front cover 62. Specifically, as illustrated in FIG. 1, the unit body 84 is disposed between the storage unit 12 and the exposure device 36. When the unit body 84 is drawn from the image forming apparatus body 11, the manual feed tray cover 82, the manual feed tray 86, and the extension tray 88 are drawn from the image forming apparatus body 11 integrally with the unit body 84.

As illustrated in FIG. 7, the upper surface of the unit body 84 is formed with a transport path surface 81A corresponding to one side (lower side) of a transport path (see FIG. 1) for transporting the recording medium P fed from the manual feed tray 86 into the image forming apparatus body 11. Further, the upper surface of the unit body 84 is provided with a separation roller 79B for suppressing multiple feeding of recording media P loaded on the manual feed tray 86. Furthermore, the upper surface of the unit body 84 is provided with halves (lower halves) of plural pairs of transport rollers 77 disposed along the transport path 81.

The separation roller 79B is disposed under a feed roller 79A, which feeds the recording medium P from the manual feed tray 86 into the image forming apparatus body 11, to face the feed roller 79A. If plural recording media P are fed from the manual feed tray 86 by the feed roller 79A, the separation roller 79B applies transport resistance to any lower recording medium P of the plural recording media P, to thereby separate the lower recording medium P from an upper recording medium P and suppress multiple feeding of the recording media P.

As illustrated in FIG. 5, a lower portion of the manual feed tray cover 82 is supported by a support part 83 to be rotatable around an axis along the X and −X directions at a −Z direction-side end portion of the unit body 84. Accordingly, when the manual feed tray cover 82 rotates from the image forming apparatus body 11 toward the outside of the image forming apparatus 10 (in an A direction in FIG. 5), the manual feed tray cover 82 is opened from the image forming apparatus body 11. When the manual feed tray cover 82 in this state rotates toward the image forming apparatus body 11 (in a B direction in FIG. 5), the manual feed tray cover 82 is closed toward the image forming apparatus body 11. A rotational axis of the manual feed tray cover 82 defined by the support part 83 is located coaxially with a rotational axis of the front cover 62 defined by the support part 64.

A leading end surface (free end surface) 82A of the manual feed tray cover 82 is formed with the fitting holes 91, in which the holding projections 70 of the front cover 62 are fit. When the holding projections 70 are fit in the fitting holes 91, the manual feed tray cover 82 is held by the front cover 62. Thereby, a closed state in which the manual feed tray cover 82 is closed on the front cover 62 is maintained. Further, when the holding projections 70 are released from the fitting holes 91, and if the later-described hook portions 95 are released from the latching holes 72, the manual feed tray cover 82 is separated from the front cover 62.

As illustrated in FIG. 4, in the closed state in which the manual feed tray cover 82 is closed on the front cover 62, the manual feed tray cover 82 is openable from and closable onto the image forming apparatus body 11 integrally with the front cover 62. Further, with the manual feed tray cover 82 and the front cover 62 integrally opened, the interior of the image forming apparatus body 11 is exposed, and the developer storing containers 54 to be provided inside the image forming apparatus body 11 are attachable to and detachable from the image forming apparatus body 11.

Further, as illustrated in FIGS. 2 and 5, the manual feed tray cover 82 is singly openable from and singly closable onto the image forming apparatus body 11 independently of the front cover 62. With the manual feed tray cover 82 singly opened, the manual feed tray 86 is exposed and allows the recording medium P to be stored therein. The recording medium P stored in the manual feed tray 86 is fed into the image forming apparatus body 11 by the feed roller 79A, and is transported to the second transfer position T2 by the transport rollers 77 and 50. Then, an image is formed on the recording medium P, as described above.

Figure 8:
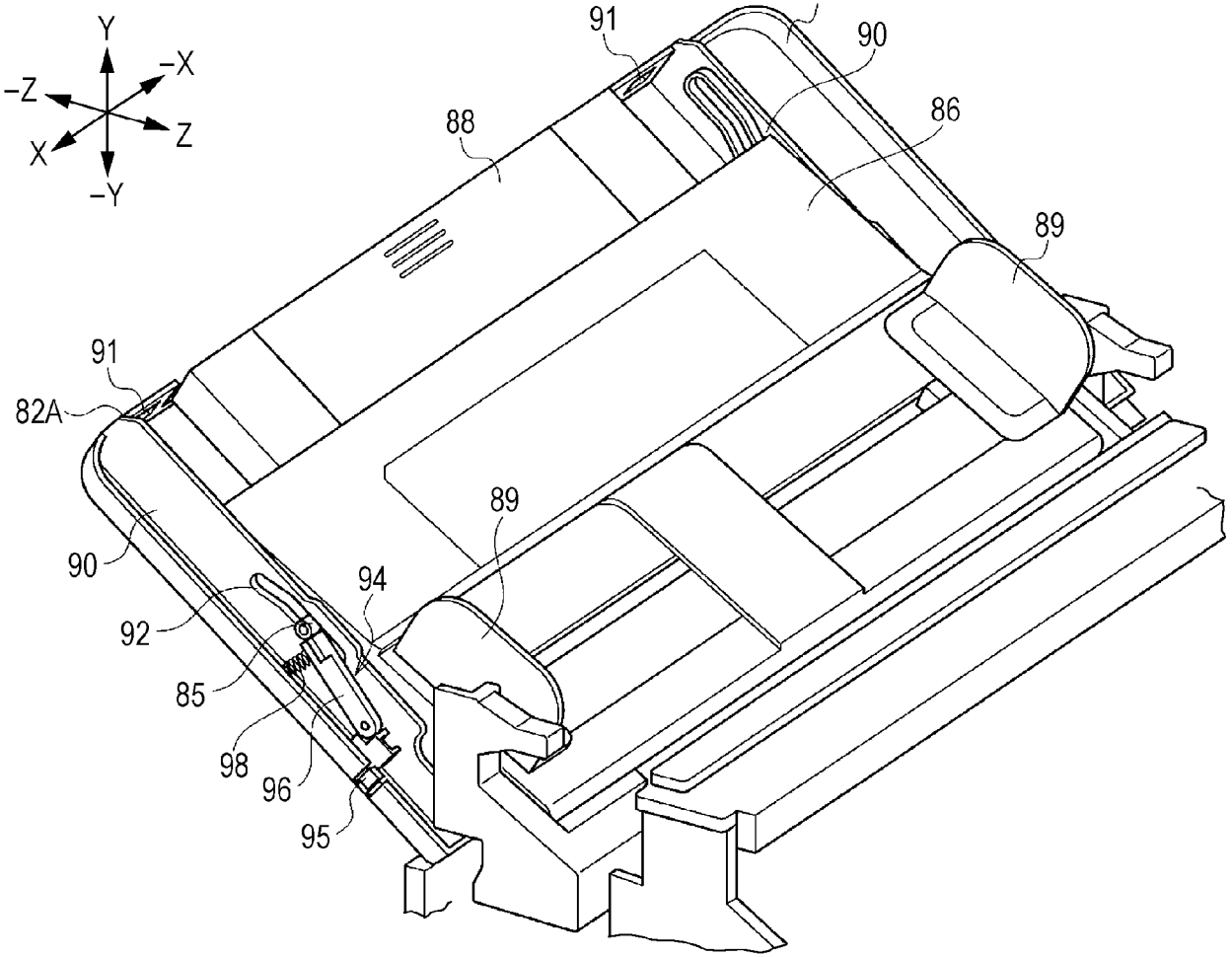
FIG. 8 is a perspective view illustrating a configuration of a latch mechanism according to the exemplary embodiment.

The manual feed tray 86 is formed into a plate shape having a hollow interior, and is provided on the inner surface (Z direction-side surface) of the manual feed tray cover 82, as illustrated in FIG. 8. The recording medium P is loaded on the manual feed tray 86 and the extension tray 88 to be stored therein. The manual feed tray 86 is provided with a pair of holding members 89 which hold, on both sides of the recording medium P, the recording medium P loaded on the manual feed tray 86. Each of the paired holding members 89 is configured to slidingly move in the X direction (−X direction) in accordance with the width of the loaded recording medium P.

Figure 9:
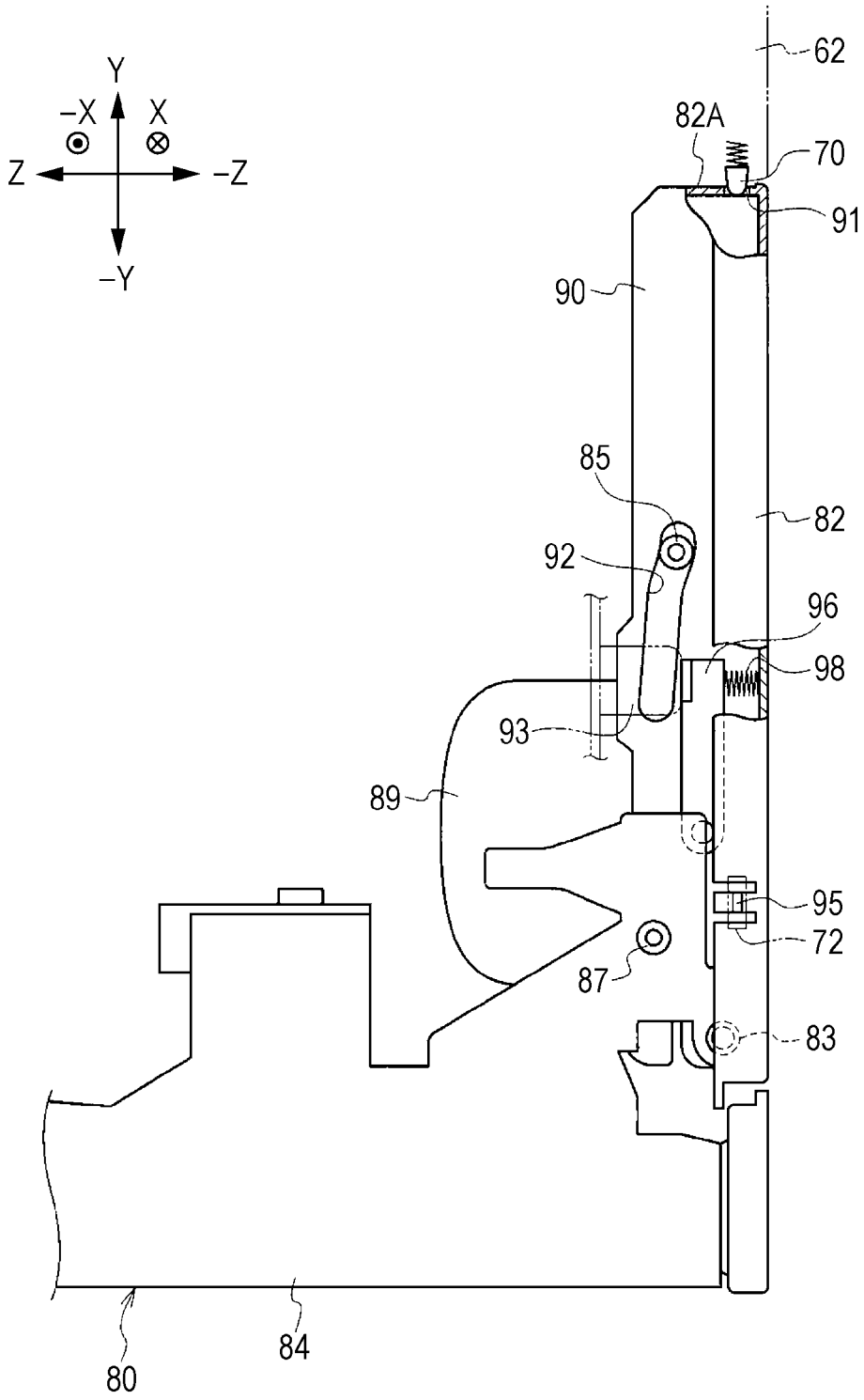
FIG. 9 is a side view illustrating the latch mechanism in a state in which the front cover and the manual feed tray cover according to the exemplary embodiment are closed on the image forming apparatus body.

Further, as illustrated in FIG. 9, a lower portion (base end portion) of the manual feed tray 86 is supported by a support part 87 to be rotatable around an axis along the X and −X directions at a −Z direction-side end portion of the unit body 84. As illustrated in FIG. 8, opposite side surfaces of an upper portion (free end portion) of the manual feed tray 86 are respectively provided with shaft parts 85 inserted in later-described guide holes 92. FIG. 8 illustrates only the shaft part 85 on one of the side surfaces.

An X direction-side end portion and a −X direction-side end portion of the inner surface (Z direction-side surface) of the manual feed tray cover 82 are provided with a pair of side plates 90 to sandwich the manual feed tray 86 in the X and −X directions. Each of the paired side plates 90 is formed with the guide hole 92 which has the shaft part 85 inserted therein and guides the shaft part 85. The guide hole 92 is an elongated hole extending from the base end side toward the leading end side of the manual feed tray cover 82.

To allow an upper end portion (free end portion) of the manual feed tray 86 to slidingly move relative to the manual feed tray cover 82, a rotational axis of the manual feed tray 86 defined by the support part 87 is located at a position different from the position of the rotational axis of the manual feed tray cover 82 defined by the support part 83 (see FIG. 9).

Specifically, in a closed state of the manual feed tray cover 82 closed on the image forming apparatus body 11, each of the shaft parts 85 is located on the side of one end (upper end) of the corresponding guide hole 92 (see FIG. 9). When the manual feed tray cover 82 in the closed state closed on the image forming apparatus body 11 is opened, the shaft part 85 moves from the side of the one end (upper end) toward the other end (lower end) of the guide hole 92, and the upper end portion (free end portion) of the manual feed tray 86 slidingly moves toward a lower end portion (base end portion) of the manual feed tray cover 82 (see FIG. 10). Then, the shaft part 85 hits against the other end (lower end) of the guide hole 92, and thereby the opening of the manual feed tray cover 82 from the image forming apparatus body 11 is prevented. In this state, the angle of opening of the manual feed tray cover 82 relative to the vertical directions (Y and −Y directions) is, for example, approximately ninety degrees (see FIG. 12).

As described above, one end portion of the manual feed tray 86 is supported to be rotatable relative to the unit body 84 at a position different from the position of the rotational axis of the manual feed tray cover 82, and the other end portion of the manual feed tray 86 functions as an example of a connecting member connected to the manual feed tray cover 82 to be slidingly movable on the manual feed tray cover 82.

As illustrated in FIG. 8, on the inner surface (Z direction-side surface) of the manual feed tray cover 82, a latch mechanism 94 is provided on a side of each of the paired side plates 90 opposite to a side of the side plate 90 facing the manual feed tray 86. The latch mechanism 94 is an example of a regulation mechanism which regulates the angle of opening, relative to the image forming apparatus body 11, of the manual feed tray cover 82 singly opened from the image forming apparatus body 11. FIG. 8 illustrates only one of the latch mechanisms 94 respectively disposed on the paired side plates 90.

Each of the latch mechanisms 94 includes a latch lever 96 as an example of a hitting member which hits against the shaft part 85, a compression spring 98 serving as a biasing member which biases the latch lever 96 toward a hitting position at which the latch lever 96 hits against the shaft part 85, and a latch cover 99 (see FIG. 7) serving as a covering member which covers the latch lever 96 and the compression spring 98.

On a side surface of each of the side plates 90 opposite to a side surface of the side plate 90 facing the manual feed tray 86, the latch lever 96 is supported to be rotatable around a rotational axis along the X and −X directions. Specifically, the latch lever 96 is rotatable between the hitting position at which a leading end portion (free end portion) of the latch lever 96 hits against the shaft part 85 (see FIGS. 10 and 11) and a retraction position at which the leading end portion (free end portion) of the latch lever 96 having approached the manual feed tray cover 82 from the hitting position does not hit against the shaft part 85 of the manual feed tray 86 (see FIGS. 9 and 12).

Figure 10:
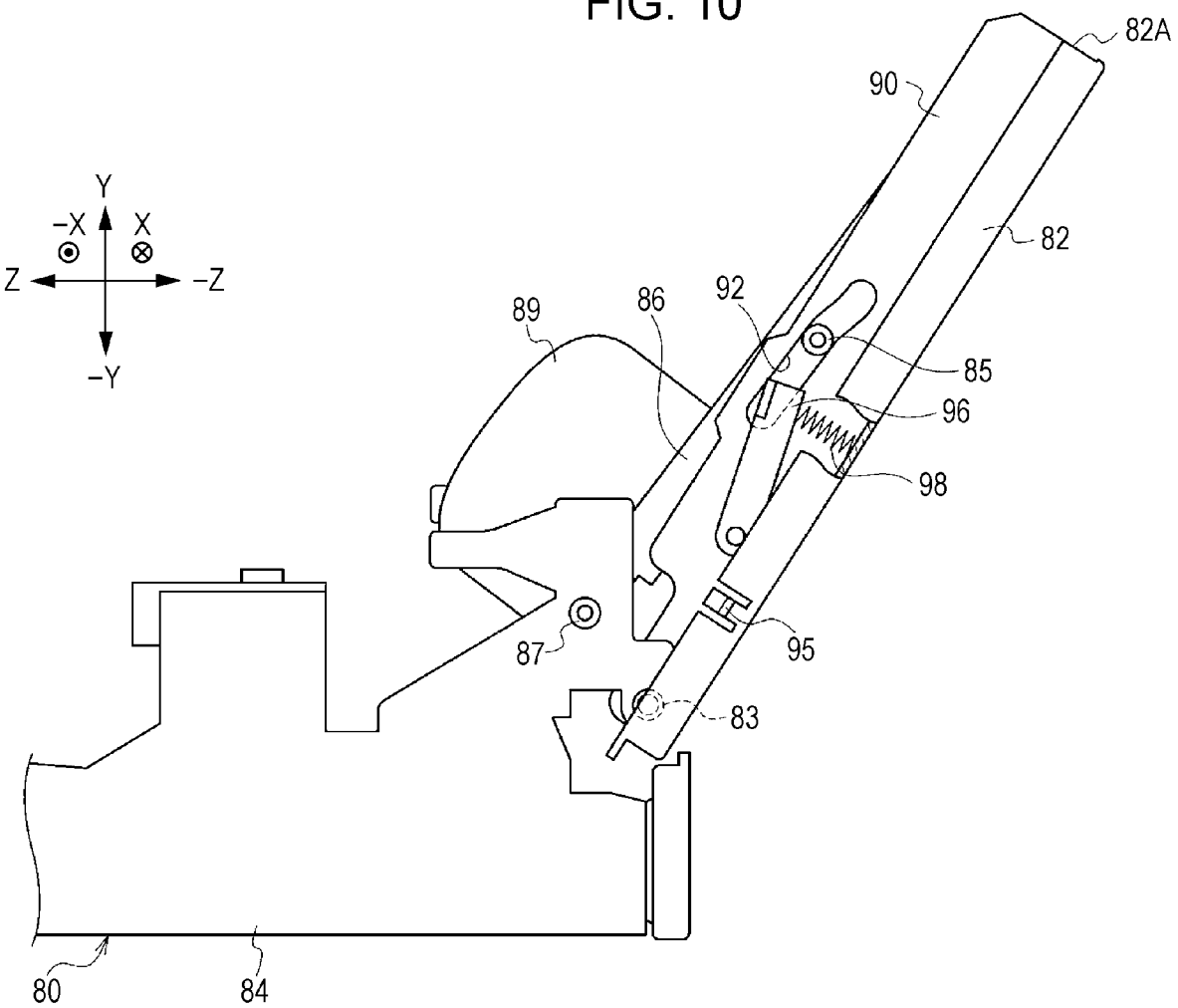
FIG. 10 is a side view illustrating the latch mechanism in a state in which the manual feed tray cover according to the exemplary embodiment has started to be singly opened from the image forming apparatus body.
Figure 11:
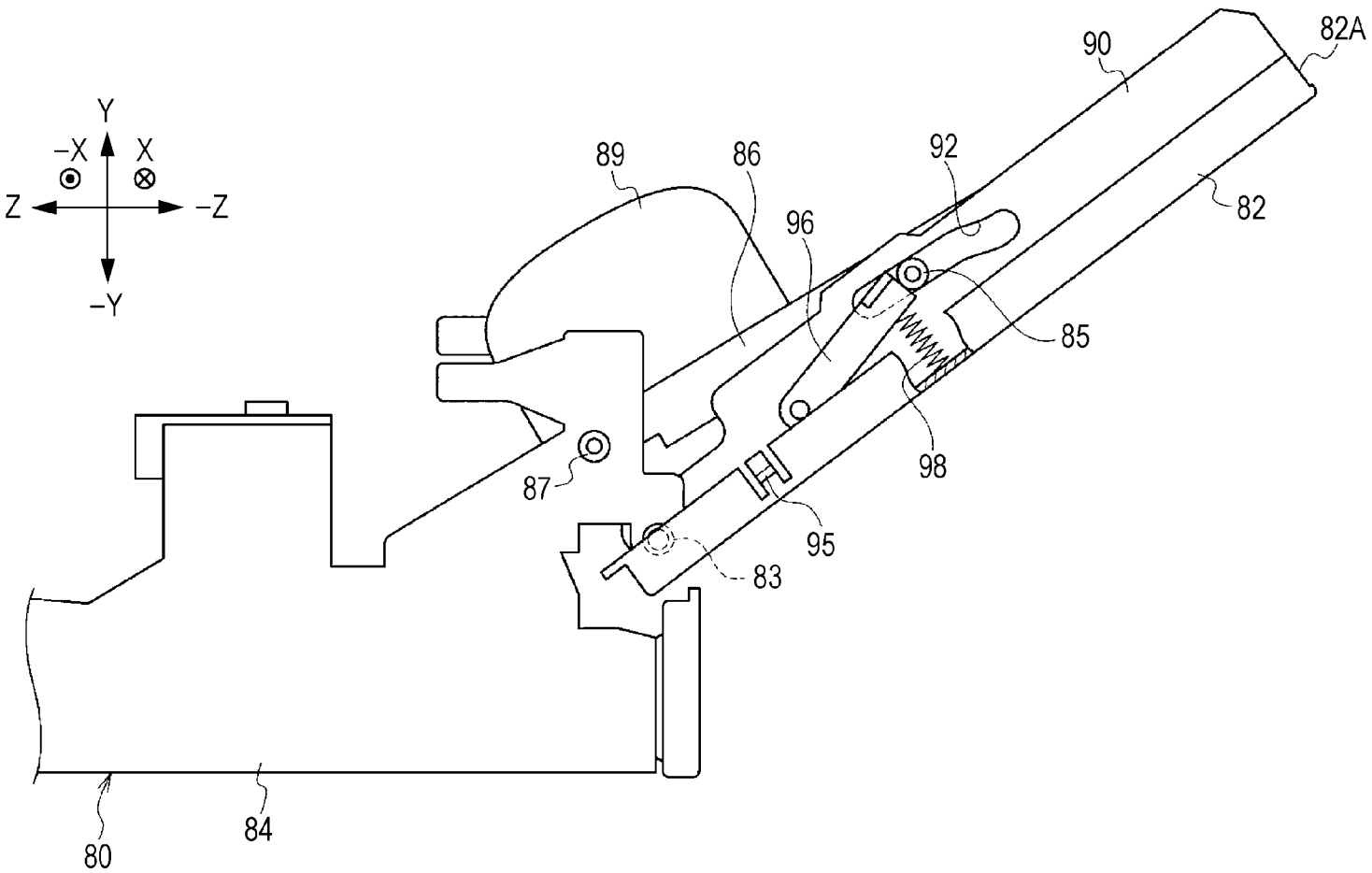
FIG. 11 is a side view illustrating the latch mechanism in a state in which the manual feed tray cover according to the exemplary embodiment is singly opened from the image forming apparatus body.

The latch lever 96 hits against the latch cover 99 (see FIG. 7) at the hitting position, and thereby is prevented from rotating in a direction separating from the manual feed tray cover 82 (opposite direction to the retraction position) beyond the hitting position (see FIGS. 10 and 11).

When the manual feed tray cover 82 is closed toward the front cover 62, the latch lever 96 located at the hitting position is pressed by the releasing projection 93 against the biasing force of the compression spring 98, and rotates to the retraction position (see FIG. 9). As illustrated in FIG. 7, the latch cover 99 is formed with an opening 99A, through which the releasing projection 93 presses the latch lever 96.

Further, as illustrated in FIG. 11, when the latch lever 96 hits against the shaft part 85 at the hitting position, the upper end portion (free end portion) of the manual feed tray 86 is prevented from slidingly moving on the manual feed tray cover 82, and the angle of opening of the manual feed tray cover 82 relative to the image forming apparatus body 11 is regulated. In this state, the angle of opening of the manual feed tray cover 82 relative to the vertical directions (Y and −Y directions) is, for example, approximately fifty degrees.

As described above, the latch mechanisms 94 are provided to the manual feed tray cover 82 independently of the image forming apparatus body 11 and the front cover 62, unlike a connecting member connecting the image forming apparatus body 11 and the manual feed tray cover 82 and a connecting member connecting the front cover 62 and the manual feed tray cover 82.

Further, on the side surfaces of the manual feed tray cover 82, the hook portions 95 as an example of holding parts for causing the manual feed tray cover 82 to be held by the front cover 62 are provided closer to the rotational axis (the support part 83) than the releasing projections 93 are, as illustrated in FIG. 8. The hook portions 95 are latched in the latching holes 72 formed in the left and right side walls 62C of the interior of the housing space 66 in the front cover 62 (see FIG. 2).

The relative position of the hook portions 95 to the latching holes 72 in the rotation direction of the manual feed tray cover 82 is set such that, when the manual feed tray cover 82 opened from the front cover 62 is closed toward the front cover 62, the manual feed tray cover 82 is held by the front cover 62 before the releasing projections 93 press the latch levers 96 and release the regulation by the latch levers 96.

As illustrated in FIG. 9, the manual feed tray cover 82 is held by the front cover 62 with the hook portions 95 located closer to the rotational axis (the support part 83) than the releasing projections 93 are and the fitting holes 91 located farther from the rotational axis (the support part 83) than the releasing projections 93 are. Provided at a position far from the rotational axis (the support part 83), the fitting holes 91 (and the holding projections 70) function to firmly hold the manual feed tray cover 82 and the front cover 62. Meanwhile, the hook portions 95 function to cause the manual feed tray cover 82 to be held by the front cover 62 before the regulation is released by the releasing projections 93. With the hook portions 95 (and the latching holes 72) provided at a position close to the rotational axis (the support part 83), the relative position of the hook portions 95 to the latching holes 72 is not easily changed, even if bending or rattling occurs in the manual feed tray cover 82 and the front cover 62.

Operation According to Exemplary Embodiment:

Subsequently, an operation according to the exemplary embodiment will be described.

According to the configuration of the exemplary embodiment, in a closed state in which the front cover 62 and the manual feed tray cover 82 are closed on the image forming apparatus body 11 (the state illustrated in FIG. 1), the releasing projections 93 of the front cover 62 are pressing the latch levers 96 to the retraction position against the biasing force of the compression springs 98, as illustrated in FIG. 9. Further, in the closed state, each of the shaft parts 85 is located on one end side (upper end side) of the corresponding guide hole 92. Furthermore, in the closed state, the holding projections 70 of the front cover 62 are fit in the fitting holes 91 of the manual feed tray cover 82, and the hook portions 95 of the manual feed tray cover 82 are latched in the latching holes 72 of the front cover 62. Thereby, the manual feed tray cover 82 is held by the front cover 62.

In the closed state, if the manual feed tray cover 82 starts to be singly opened by an operator, the holding of the manual feed tray cover 82 by the holding projections 70 and the hook portions 95 is released. Further, as illustrated in FIG. 10, the releasing projections 93 separate from the latch levers 96, and the latch levers 96 rotationally move to the hitting position owing to the biasing force of the compression springs 98. Further, each of the shaft parts 85 of the manual feed tray 86 starts to move toward the other end side (lower end side) of the corresponding guide hole 92.

As illustrated in FIG. 11, if the operator further opens the manual feed tray cover 82, the shaft parts 85 of the manual feed tray 86 hit against the latch levers 96, and the upper end portion (free end portion) of the manual feed tray 86 is prevented from slidingly moving on the manual feed tray cover 82. Thus, the angle of opening of the manual feed tray cover 82 relative to the image forming apparatus body 11 is regulated. Thereby, the manual feed tray cover 82 is opened to a first angle of opening (approximately fifty degrees, for example) relative to the vertical directions.

Further, with the manual feed tray cover 82 singly opened, the manual feed tray 86 is exposed and allows the recording medium P to be stored therein. The recording medium P stored in the manual feed tray 86 is fed into the image forming apparatus body 11 by the feed roller 79A, and is transported to the second transfer position T2 by the transport rollers 77 and 50 (see FIG. 1). Then, an image is formed on the recording medium P.

As described above, in the exemplary embodiment, when the manual feed tray cover 82 is singly opened, the angle of opening of the manual feed tray cover 82 is regulated. Therefore, the angle of contact between the recording medium P loaded on the manual feed tray 86 provided on the manual feed tray cover 82 and the feed roller 79A for feeding the recording medium P is set to an appropriate angle.

Figure 12:
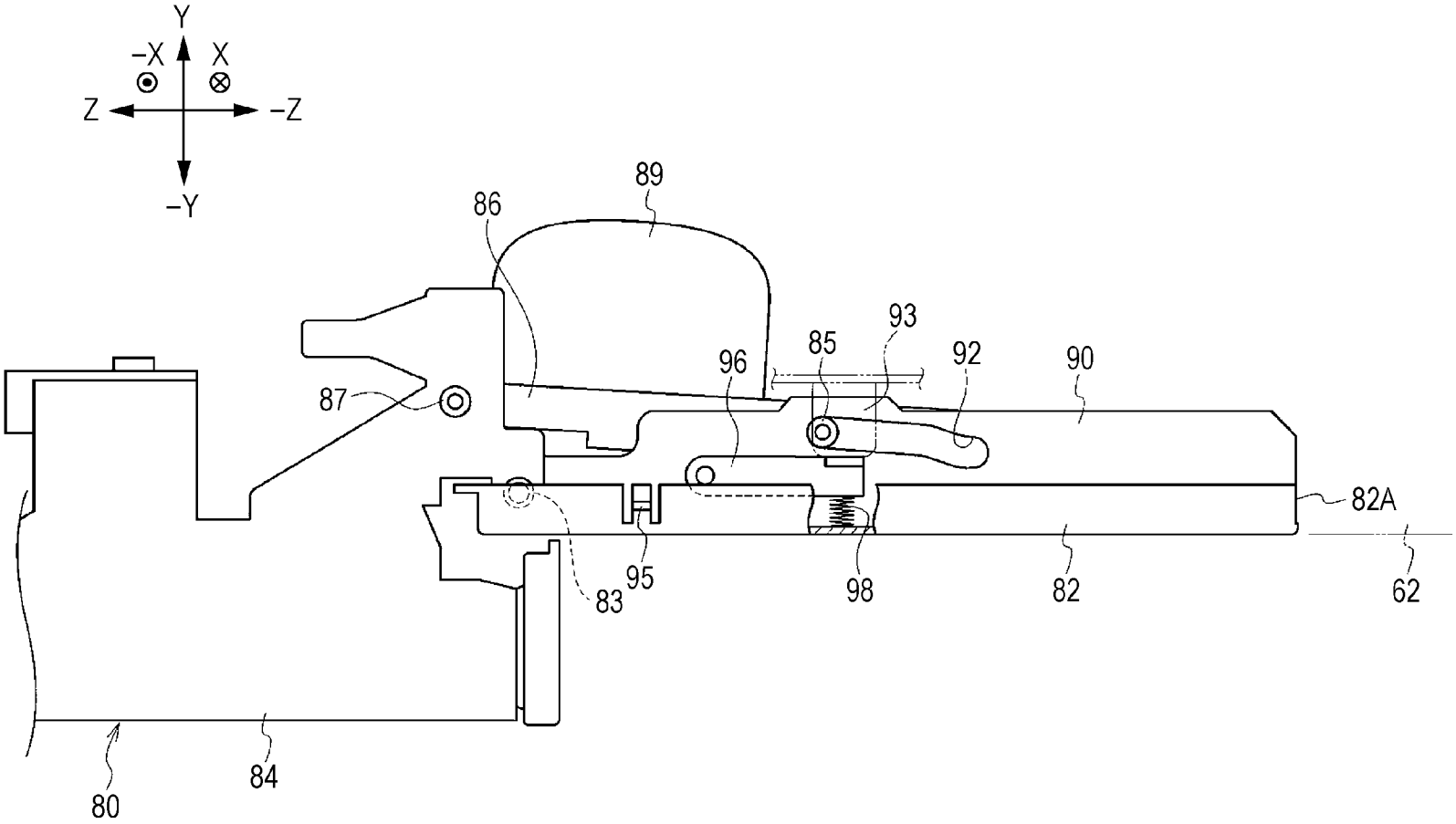
FIG. 12 is a side view illustrating the latch mechanism in a state in which the front cover and the manual feed tray cover according to the exemplary embodiment are opened from the image forming apparatus body.

Meanwhile, in the closed state in which the front cover 62 and the manual feed tray cover 82 are closed on the image forming apparatus body 11 (the state illustrated in FIG. 1), if the operator operates the front cover 62 and opens the front cover 62 and the manual feed tray cover 82, a state is maintained in which the releasing projections 93 of the front cover 62 are pressing the latch levers 96 to the retraction position against the biasing force of the compression springs 98, as illustrated in FIG. 12. If the front cover 62 and the manual feed tray cover 82 are opened, therefore, each of the shaft parts 85 of the manual feed tray 86 moves from the one end side of the corresponding guide hole 92 toward the other end side of the guide hole 92 without hitting against the latch lever 96, and hits against the other end of the guide hole 92. Thus, the opening of the manual feed tray cover 82 from the image forming apparatus body 11 is prevented. Thereby, the manual feed tray cover 82 and the front cover 62 are opened to a second angle of opening (approximately ninety degrees, for example), which is greater than the first angle of opening, relative to the vertical directions. In this process, the stopper 63C of the regulation mechanism 63 hits against the prevented portion 63E formed at the other end portion of the connecting member 63A, as illustrated in FIG. 4. Thereby, the angle of opening of the front cover 62 is regulated to the second angle of opening (approximately ninety degrees, for example).

Further, with the manual feed tray cover 82 and the front cover 62 integrally opened, the interior of the image forming apparatus body 11 is exposed, as illustrated in FIG. 4. Accordingly, the developer storing containers 54 to be provided inside the image forming apparatus body 11 are attachable to and detachable from the image forming apparatus body 11.

As described above, in the exemplary embodiment, when the manual feed tray cover 82 and the front cover 62 are integrally opened, the angle of opening is greater than in a case where the manual feed tray cover 82 is singly opened. Therefore, the exemplary embodiment allows an attachment or detachment operation of attaching or detaching the developer storing containers 54 to be performed with ease.

Further, if the recording medium P fed from the manual feed tray 86 is jammed in the transport path 81 (in the event of a jam) in an opened state in which the manual feed tray cover 82 is singly opened, the operator draws from the image forming apparatus body 11 the manual feed tray unit 80 including the manual feed tray cover 82, as illustrated in FIGS. 3 and 6. With the manual feed tray unit 80 drawn from the image forming apparatus body 11, the transport path 81 is opened. Then, the operator removes the recording medium P jammed in the transport path 81.

In the exemplary embodiment, the latch mechanisms 94 respectively including the latch levers 96 are provided to the manual feed tray cover 82 independently of the image forming apparatus body 11 and the front cover 62. Therefore, the manual feed tray unit 80 is drawn from the image forming apparatus body 11 independently of the front cover 62.

Further, in the exemplary embodiment, even if the front cover 62 is opened from the image forming apparatus body 11 in the opened state in which the manual feed tray cover 82 is singly opened, for example, the latch levers 96 are not pressed to the retraction position by the releasing projections 93 before the manual feed tray cover 82 is held by the front cover 62 with the hook portions 95. Therefore, the regulation of the angle of opening by the latch mechanisms 94 is released when the front cover 62 and the manual feed tray cover 82 are integrally opened or closed, and is not released when the manual feed tray cover 82 is singly opened or closed. Therefore, the manual feed tray cover 82 is prevented from being singly opened to the second angle of opening (approximately ninety degrees, for example).

Accordingly, if the front cover 62 is opened from the image forming apparatus body 11 in the opened state in which the manual feed tray cover 82 is singly opened, the front cover 62 holds the manual feed tray cover 82, and thereafter the releasing projections 93 move the latch levers 96 to the retraction position. Thereby, the front cover 62 and the manual feed tray cover 82 are integrally opened to the second angle of opening (approximately ninety degrees, for example).

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An opening and closing mechanism comprising:

a first opening and closing unit that is supported to be rotatable relative to an apparatus body, and that is opened from or closed onto the apparatus body in accordance with the rotation thereof;

a drawer unit that is provided to the apparatus body to be drawable from the apparatus body toward a side of the apparatus body provided with the first opening and closing unit;

a second opening and closing unit that is supported to be drawable from the apparatus body integrally with the drawer unit and be rotatable relative to the drawer unit, and that is rotated integrally with the first opening and closing unit to be opened from or closed onto the apparatus body integrally with the first opening and closing unit, and is singly rotated independently of the first opening and closing unit to be singly opened from or closed onto the apparatus body; and a plurality of regulation mechanisms that are provided to the second opening and closing unit independently of the apparatus body and the first opening and closing unit, and that regulate the angle of opening, relative to the apparatus body, of the second opening and closing unit singly opened from the apparatus body, wherein the plurality of regulation mechanisms regulate the angle of opening, relative to the apparatus body, of the second opening and closing unit while the second opening and closing unit is singly opened from the apparatus body.

2. The opening and closing mechanism according to claim 1, further comprising:

releasing parts that are provided to the first opening and closing unit, and that release the regulation by the regulation mechanisms in a closed state in which the second opening and closing unit is closed on the first opening and closing unit.

3. The opening and closing mechanism according to claim 2, further comprising:

holding parts that are provided to the second opening and closing unit, and that, when the second opening and closing unit opened from the first opening and closing unit is closed onto the first opening and closing unit, cause the second opening and closing unit to be held by the first opening and closing unit before the releasing parts release the regulation by the regulation mechanisms, wherein the holding parts are separate from the releasing parts.

4. The opening and closing mechanism according to claim 1, further comprising:

a connecting member that has one end portion supported to be rotatable relative to the drawer unit at a position different from the position of a rotational axis of the second opening and closing unit, and has an other end portion connected to the second opening and closing unit to be displaceable relative to the second opening and closing unit, wherein each of the regulation mechanisms includes a hitting member that hits against the other end portion of the connecting member to regulate the relative displacement of the other end portion of the connecting member to the second opening and closing unit and thereby regulate the angle of opening of the second opening and closing unit relative to the apparatus body.

5. The opening and closing mechanism according to claim 2, further comprising:

a connecting member that has one end portion supported to be rotatable relative to the drawer unit at a position different from the position of a rotational axis of the second opening and closing unit, and has an other end portion connected to the second opening and closing unit to be displaceable relative to the second opening and closing unit, wherein each of the regulation mechanisms includes a hitting member that hits against the other end portion of the connecting member to regulate the relative displacement of the other end portion of the connecting member to the second opening and closing unit and thereby regulate the angle of opening of the second opening and closing unit relative to the apparatus body.

6. The opening and closing mechanism according to claim 3, further comprising:

a connecting member that has one end portion supported to be rotatable relative to the drawer unit at a position different from the position of a rotational axis of the second opening and closing unit, and has an other end portion connected to the second opening and closing unit to be displaceable relative to the second opening and closing unit, wherein each of the regulation mechanisms includes a hitting member that hits against the other end portion of the connecting member to regulate the relative displacement of the other end portion of the connecting member to the second opening and closing unit and thereby regulate the angle of opening of the second opening and closing unit relative to the apparatus body.

7. The opening and closing mechanism according to claim 5, wherein each of the releasing parts serves as a pressing member that, in the closed state in which the second opening and closing unit is closed on the first opening and closing unit, presses the hitting member to a position at which the hitting member does not hit against the other end portion of the connecting member.

8. The opening and closing mechanism according to claim 6, wherein each of the releasing parts serves as a pressing member that, in the closed state in which the second opening and closing unit is closed on the first opening and closing unit, presses the hitting member to a position at which the hitting member does not hit against the other end portion of the connecting member.

9. An image forming apparatus comprising:

an apparatus body including an image forming section that forms an image on a recording medium; and an opening and closing mechanism provided to the apparatus body, the opening and closing mechanism including:

a first opening and closing unit that is supported to be rotatable relative to the apparatus body, and that is opened from or closed onto the apparatus body in accordance with the rotation thereof, a drawer unit that is provided to the apparatus body to be drawable from the apparatus body toward a side of the apparatus body provided with the first opening and closing unit, a second opening and closing unit that is supported to be drawable from the apparatus body integrally with the drawer unit and be rotatable relative to the drawer unit, and that is rotated integrally with the first opening and closing unit to be opened from or closed onto the apparatus body integrally with the first opening and closing unit, and is singly rotated independently of the first opening and closing unit to be singly opened from or closed onto the apparatus body, and regulation mechanisms that are provided to the second opening and closing unit independently of the apparatus body and the first opening and closing unit, and that regulate the angle of opening, relative to the apparatus body, of the second opening and closing unit singly opened from the apparatus body, wherein the second opening and closing unit includes a storage unit that stores the recording medium to be fed into the apparatus body, and the drawer unit is formed with a transport path for transporting the recording medium, and wherein the regulation mechanisms regulate the angle of opening, relative to the apparatus body, of the second opening and closing unit while the second opening and closing unit is singly opened from frog the apparatus body.

10. The image forming apparatus according to claim 9, wherein the opening and closing mechanism further includes releasing parts that are provided to the first opening and closing unit, and that release the regulation by the regulation mechanisms in a closed state in which the second opening and closing unit is closed on the first opening and closing unit.

11. The opening and closing mechanism according to claim 1, wherein each of the plurality of regulation mechanisms comprises a rotatable latch lever.

12. The opening and closing mechanism according to claim 11, wherein each of the plurality of regulation mechanisms further comprises a biasing member.

13. The opening and closing mechanism according to claim 1, wherein a maximum angle of opening of the second opening and closing unit integrally rotated with the first opening and closing unit is greater than a maximum angle of opening of the second opening and closing unit singly opened from the apparatus body.

14. The opening and closing mechanism according to claim 1, wherein the plurality of regulation mechanisms regulate the angle of opening, relative to the apparatus body, of the second opening and closing unit after the second opening and closing unit has already been singly opened from the apparatus body.

15. The opening and closing mechanism according to claim 3, wherein the holding parts are provided closer to a rotational axis of the second opening and closing unit than the releasing parts.

16. The opening and closing mechanism according to claim 1, wherein an angle of opening in a case where the second opening and closing unit and the first opening and closing unit are integrally opened from the apparatus body is greater than an angle of opening in a case where the second opening and closing unit is singly opened from the apparatus body.

17. The image forming apparatus according to claim 9, wherein an angle of opening in a case where the second opening and closing unit and the first opening and closing unit are integrally opened from the apparatus body is greater than an angle of opening in a case where the second opening and closing unit is singly opened from the apparatus body.

18. The opening and closing mechanism according to claim 1, wherein the opening and closing mechanism is configured such that, if the first opening and closing unit is opened from the apparatus body in a state in which the second opening and closing unit is singly opened, the first opening and closing unit holds the second opening and closing unit, and thereafter the first opening and closing unit and the second opening and closing unit are integrally opened.

19. The image forming apparatus according to claim 9, wherein the image forming apparatus is configured such that, if the first opening and closing unit is opened from the apparatus body in a state in which the second opening and closing unit is singly opened, the first opening and closing unit holds the second opening and closing unit, and thereafter the first opening and closing unit and the second opening and closing unit are integrally opened.

20. The opening and closing mechanism according to claim 1, wherein the plurality of regulation mechanisms are a plurality of independent regulation mechanisms.

21. The opening and closing mechanism according to claim 1, wherein the plurality of regulation mechanisms function independently of the apparatus body and the first opening and closing unit.

* * * * *